United States Patent [19]

Beck

[11] 4,251,978

[45] Feb. 24, 1981

[54] CARTON CLOSURE INFOLDER

[75] Inventor: Charles C. Beck, Bloomington, Minn.

[73] Assignee: Paxall, Inc., Chicago, Ill.

[21] Appl. No.: 9,515

[22] Filed: Feb. 5, 1979

[51] Int. Cl.[3] ..... B65B 7/20

[52] U.S. Cl. ..... 53/491; 53/374; 53/378

[58] Field of Search ..... 53/374, 373, 375, 376, 53/377, 378, 379, 491, 477, 484

[56] References Cited

U.S. PATENT DOCUMENTS

| | | | |
|---|---|---|---|
| 1,948,657 | 2/1934 | Ferguson | 53/491 X |
| 2,391,708 | 12/1945 | Johnson et al. | 53/375 |
| 2,485,235 | 10/1949 | Graf | 53/374 |
| 2,677,220 | 5/1954 | Fischer et al. | 53/477 |
| 4,063,403 | 12/1977 | Bergstein et al. | 53/379 |

*Primary Examiner*—Horace M. Culver

*Attorney, Agent, or Firm*—Fitch, Even, Tabin, Flannery & Welsh

[57] ABSTRACT

Apparatus for automatically folding the end closure of a carton of rectangular cross section which includes a cover panel hinged to a rear sidewall of the carton and a pair of flanking gusset panels which are each respectively hinged to one edge of the cover panel and to an adjacent sidewall. The carton is continuously moved along a conveyor path with one of the gusset panels leading and the other trailing. A folding head moves along a parallel conveyor path and translates to a location adjacent the carton. An abutment adjacent the conveyor path contacts the leading gusset panel and folds it inward along a line at about a 45° angle to its hinged edges. An arm mounted on the folding head is caused to swing relative to the conveyor to fold the trailing gusset panel inward along a line at about a 45° angle to its hinged edges.

11 Claims, 13 Drawing Figures

CARTON CLOSURE INFOLDER

BACKGROUND OF THE INVENTION

This invention relates to packaging and more specifically to apparatus for folding the end closures of cartons of the type which include a pair of gusset closure panels.

U.S. Pat. No. 4,046,308, issued Sept. 6, 1977, discloses such an end-sealing package which is designed to provide a totally moisture-resistant inner barrier within an outer paperboard carton. The package is formed from a laminated blank wherein a moisture-resistant film material having heat-sealing characteristics, such as polyethylene film, is adhered to a fiberboard substrate by a heat-weakenable laminant, such as microcrystalline wax. The blank may be formed by die-cutting sheets or rolls of such a lamination so that the two layers will be substantially coextensive. During the formation of the blank into a tubular body by side-seaming and subsequentially during the heat-sealing of the end closures, portions or panels of the fiberboard substrate are separated from the inner lining by selective heat delamination.

Apparatus for closing and sealing the ends of packages of this general type, which is illustrated in the aforementioned U.S. patent, takes the form of a pair of synchronized, intermittently rotating turrets, each of which has a plurality of pocket members into which individual cartons are received. More versatile apparatus for closing and sealing such packages has been found desirable.

BRIEF SUMMARY OF THE INVENTION

It has been found advantageous to create packaging apparatus for the high-speed handling, filling, closing and sealing of this general type of gusseted carton which employs both straight-line and rotary movement of the packages. The filling of the carton is efficiently carried out in a rotary, turret-like arrangement which is located between two straight-line sections where the formation of the bottom and top end closures are respectively effected. It has been found that there are advantages to manipulating the end closures during the sealing and closing steps while the cartons are being moved in a straight-line. One advantage lies in being able to run the conveyor continuously, as opposed to intermittently, which itself is conductive to higher speed operation, and another lies in the versatility of operation. However, there is difficulty in effecting the folding of gusseted end closures while they are continuously moving, and the present invention provides apparatus for automatically carrying out such a folding operation.

DETAILED DESCRIPTION OF THE PREFERRED EMBODIMENT

Figure 1:
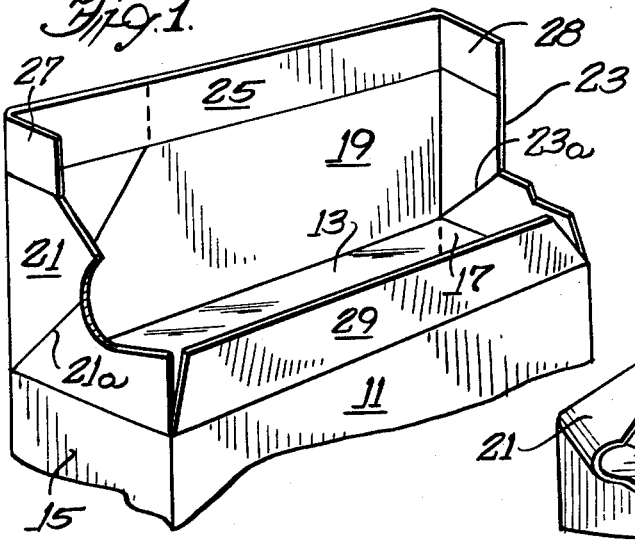
FIG. 1 is a perspective view showing the carton as it would appear in its filled condition prior to the folding of the upper end closure.

A typical gusset carton of the general type which the present invention is designed to manipulate is depicted in FIGS. 1 through 6. The carton is formed from a single blank of laminated material, namely, a fiberboard substrate to which polyethylene sheeting is adhered by a thin layer of heat-flowable material, such as microcrystalline wax. The fiberboard substrate may be of any reasonable density and thickness, for example, 40 pound bleached kraft board. The sheeting may be as thin as 2 mil low density polyethylene film, or a suitable lamination of foil and one or more synthetic resin materials may be used so long as the exposed surface is a heat-sealable material. The laminating material is preferably a microcrystalline wax or some other suitable material which melts at a temperature below the heat-sealing temperature of the thermoplastic surface of the sheeting. Accordingly, as pointed out in the aforementioned patent, during heat-sealing operation, the wax melts and is absorbed into the relatively porous fiberboard surface, thus selectively delaminating the fiberboard substrate from the film liner in the particular region.

In the side-scanning operation, with which the present application is not concerned, the flat blank is formed into a flat-folded tube which, when opened, has a rectangular cross section. The carton has four sidewalls which are referred to, for reference purposes, as a front wall 11, a rear wall 13 and a pair of lateral walls 15,17. The end closure is formed by panels which are extensions of these sidewalls and which are hinged to the upper edges thereof. A similar end closure is preferably provided at the bottom of the carton; however, a different type of end closure could be used if desired for some reason.

The end closure includes a major or cover panel 19 which is hinged to the rear wall 13 of the carton and which is of a sufficient size to completely cover the entire opening. A pair of gusset panels 21,23 are provided at the top of each of the lateral sidewalls 15,17 one edge of which is hinged thereto whereas the other edge of which is hinged to a lateral edge of the cover panel 19. These gusset panels 21,23 are provided, respectively, with a crease or fold line **21*a*,23*a* which extends at a 45° angle from the edge along which the gusset is hinged to the underlying sidewall. A flange panel 25 is attached to the free edge of the cover panel 19, and short flange extensions 27,28 are hinged to the upper edges of the gusset panels 21,23. A short flap 29 is hinged to the upper edge of the front wall 11; however, the adjacent edges between the front flap 29 and the gusset panels 21,23 are only partially severed so that the substrate or fiberboard layer is weakened but the sheeting is not cut. Thus, when the front flap 29 and the gusset panels 21,23** are outfolded, the fiberboard tears to the corners, and the sheeting stretches across these corners and assures a complete seal is formed during the heat-sealing step, as described in detail in the aforementioned patent.

Figure 7:
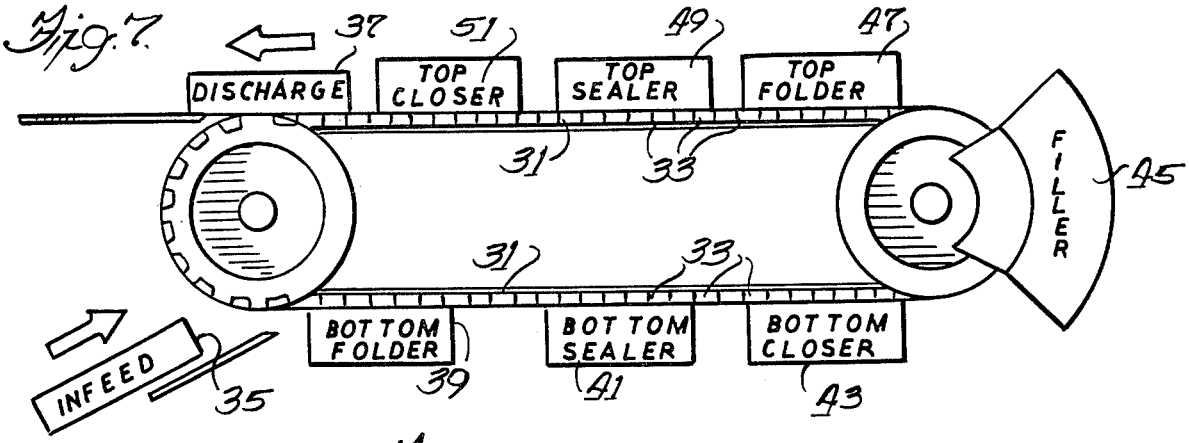
FIG. 7 is a diagrammatic view of the overall apparatus for forming, filling and sealing cartons of the type shown in FIG. 1.
Figure 8:
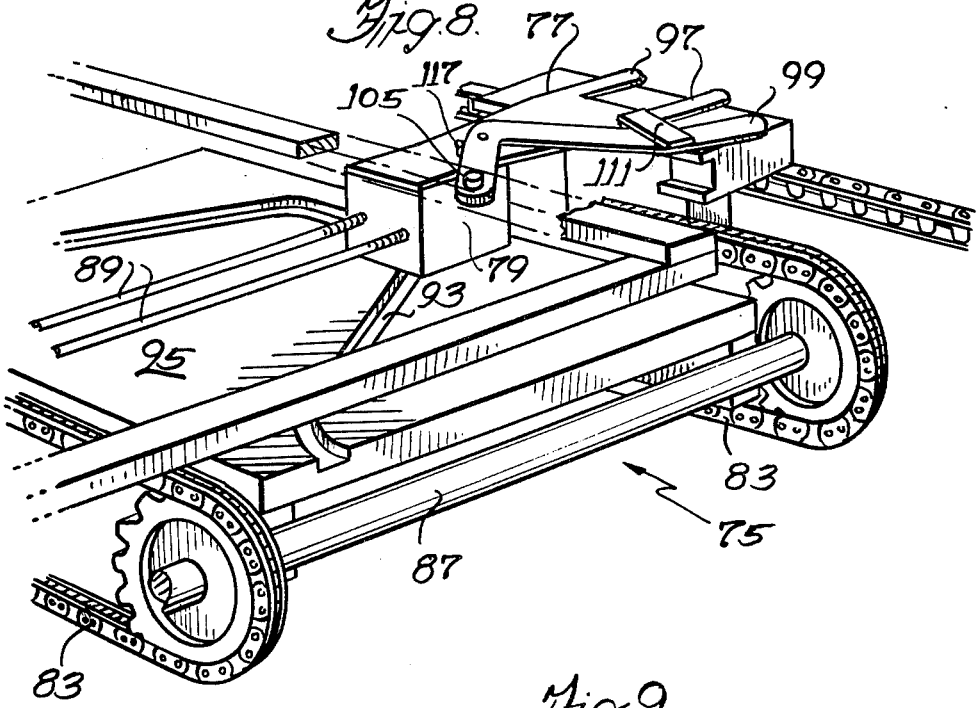
FIGS. 8 and 9 are perspective views of the portion of the apparatus for infolding the gusset panels and closing the cover panel of the top closure subsequent to the heat-sealing operation.
Figure 9:
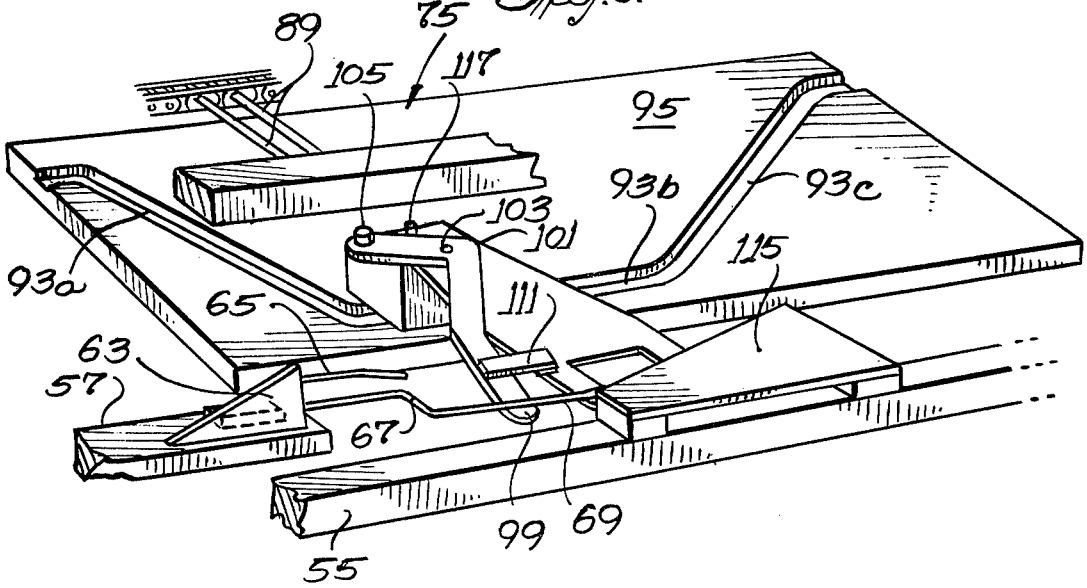

Overall apparatus is diagrammatically illustrated in FIG. 7 for automatically removing the flat-folded carton blanks from a stack in a magazine and forming, filling and sealing them into completed packages. Described in detail hereinafter is the portion of the apparatus for completing the manipulation of the upper end closure. It should be understood that the same mechanisms are employed to initially manipulate, seal and close the bottom end closure; however, inasmuch as the mechanism for operating on the upper end closure is easier to illustrate, it was chosen.

The cartons are carried by an endless chain conveyor 31 which carries a series of U-shaped pocket members 33, each of which is proportioned to receive a single carton. The conveyor 31 includes a heavy roller chain to which each pocket member 33 is linked by a suitable bracket and which is continuously driven at a constant speed so that the pocket members 33 move along an endless path. An infeed device 35 and a take-off device 37 are located adjacent one end of the conveyor 31 where the chains change direction at a rotary end section. There are two essentially straight run sections which extend between the rotary ends. The folding of the bottom end closure is effected by mechanism 39 located at the beginning of the first straight run section. The bottom of the inner liner is then totally heat-sealed by a bottom sealer 41 which also delaminates the lower end closure sheeting panels from selected of the fiberboard panels. Thereafter, the outer fiberboard end closure panels are folded by a bottom-closing mechanism 43. Next, the contents are supplied, via a rotary filler 45, through the open upper end of the carton as it travels around the other rotary end section of the conveyor. The product being filled can be a solid, a semi-solid or even a liquid. Following filling, the upper end closure is closed and sealed in a manner essentially the same as the bottom end closure.

Figure 2:
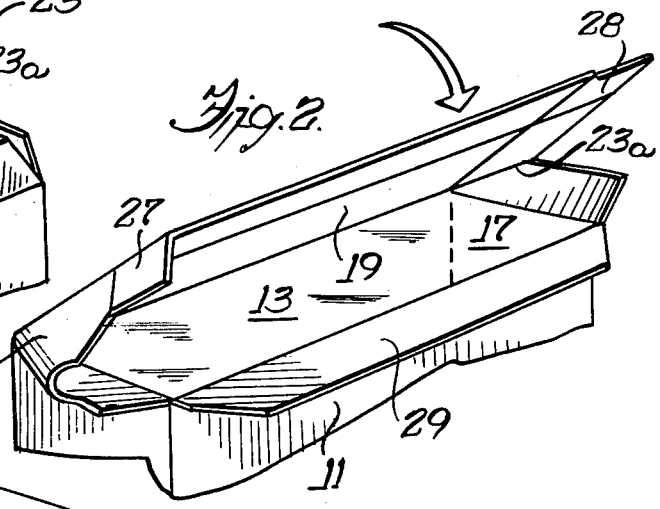
FIG. 2 is a view of the carton depicted in FIG. 1 with the gusset panels outfolded and with the upper end closure being partially collapsed as it progresses toward the initial sealing step.
Figure 3:
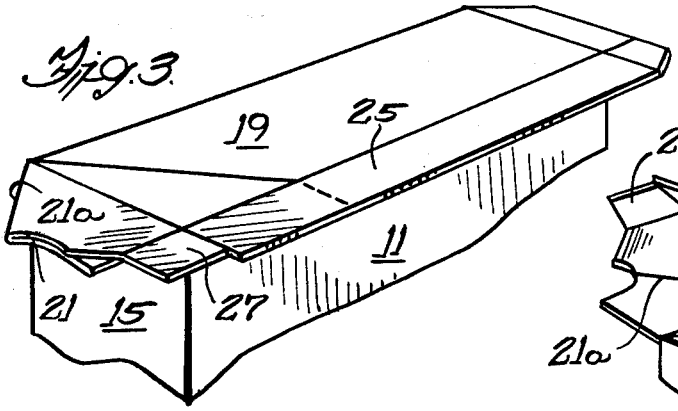
FIG. 3 is a view of the carton with the end closure outfolded in the orientation wherein heat-sealing of the film liner occurs.

The cartons leaving the rotary filler section enter a top folder 47 where the front flap 29 is first plowed outward, and then the gusset panels are outfolded along the fold lines **21*a* and 23*a*, as depicted in FIG. 2. Simultaneously with the outfolding, the cover panel 19 is plowed downward so that it completely closes the upper end opening, and heat-sealing is effected in this configuration, as depicted in FIG. 3, by a top sealer 49. Preferably, the cover panel 19, the adjacent gusset panels 21,23, the flange panels 25,27,28 and the front flap 29 are held pressed together by means of a heat-conductive belt that moves along above the pocket members 33 at exactly the same speed as the conveyor 31**. Suitable heaters are disposed adjacent the opposite, upper surface of the belt which supply the heat for the heat-sealing and delamination. The belt is preferably made of a material, such as Teflon-coated Fiberglas, Kevlar or metal, which exhibits good strength and excellent heat transfer properties.

When the carton leaves the heat-sealing section 49 and is no longer held down by the belt, the inherent resiliency of the fiberboard causes the cover and the gusset panels 21,23 to tend to spring slightly upward and separate from the now delaminated sheeting which forms the inner liner. It is in this general configuration that the carton enters the top infolding and closing section 51 of the apparatus. As the cartons are moved along by the U-shaped pockets 33 on the conveyor, they generally slide along a lower rail 53 (FIG. 13) and are prevented from leaving the pockets by a restraining bar 55 along which the rear wall 13 of the carton generally rides.

Figure 4:
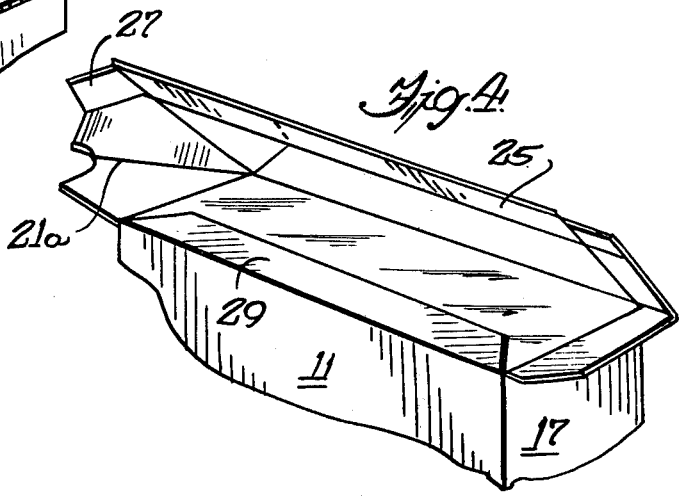
FIG. 4 is a perspective view of the carton after heat-sealing of the film liner and its heat-delamination and the turning in of the front fiberboard flap.

At the beginning of the infolding section, a main plow 57 is located which includes an inclined section 59 which lifts the front flap 29 and an adjacent edge 61 which turns it 180° through the vertical to the inturned position depicted in FIG. 4. It also includes a short triangular plow 63 which engages the undersurface of the front flange 25 and cams the cover panel 19 upward sufficiently far to complete the separation of the cover panel and the upper portions of the adjacent gusset panels from the sheeting from which they were delaminated. An extension 65 from the triangular plow 63 extends along the path of movement and holds the cover in the raised position, depicted in FIG. 4, until such time as the leading gusset 21 has been infolded.

Figure 5:
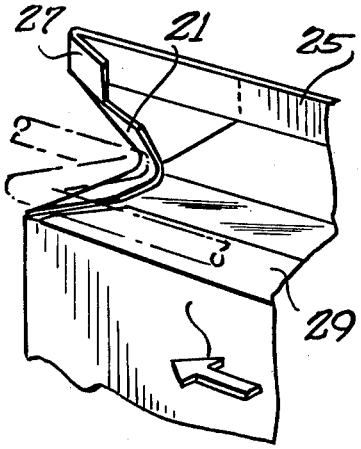
FIG. 5 is a perspective view of the carton during the initial infolding step.
Figure 6:
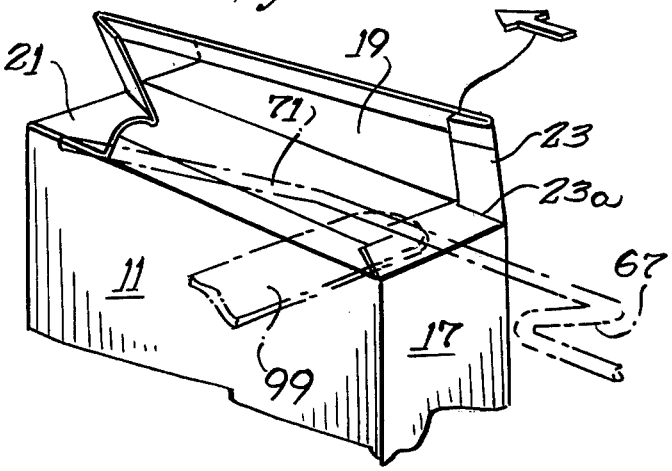
FIG. 6 is a perspective view of the carton shown in FIG. 5 after both gusset panels have been infolded and the cover panel is being plowed down.

Disposed slightly further downstream along the path of movement from the triangular plow 63 is an abutment 67 which is positioned to engage the leading gusset panel 21 and fold it inwardly on the fold line **21*a* in the manner shown in FIG. 5. The abutment 67 is formed by a right angle section of a metal rod 69 which is attached to a bracket that is screwed to the main plow 57 generally adjacent the triangular plow. Downstream of the section which forms the abutment, the rod 69 continues and is bent to form a retainer section 71 which is curved and which holds the leading gusset panel 21 in the infolded configuration as the carton is carried along the conveyor 31**.

A separate unit 75 for infolding the trailing gusset panel 23 is located adjacent the main conveyor 31. This unit 75 includes a plurality of infolding heads 77 each of which is mounted on a separate individual carriage 79 that is fastened to an auxiliary conveyor 81. The auxiliary unit 75 is suitably bolted to the main conveyor frame and includes front and rear, parallel roller chains 83 which are entrained about a pair of drive sprockets attached to a horizontal drive shaft 85 and a pair of idler sprockets carried by a spaced shaft 87. The unit 75 may contain any number of infolding sheets, for example, four, which are individually spaced apart the same distance as there is between the U-shaped pockets 33 on the main conveyor 31, and the auxiliary chain conveyor 81 is driven at the same speed as the main conveyor which it parallels. The movement of the two parallel conveyors is of course synchronized so that, as the carriages 79 move from the lower reach to the upper reach of the auxiliary conveyor 81, they are each respectively aligned with one of the U-shaped pockets 33 that is carrying a filled and sealed carton. The carriage 79 then translates toward and moves along the main conveyor for a short distance during which the infolding of the trailing gusset panel 23 occurs.

The carriage 79 is slidably mounted on a pair of parallel rods 89, the ends of which are suitably attached to the front and rear roller chains 83. Sliding movement of the carriage 79 along the rods 89 is effected by an underlying cam follower 91 which moves in a groove or track 93 provided in a flat cam plate 95 that is a stationary part of the auxiliary unit. Each folding head 77 contains a pair of flat spring fingers 97 which slide into overlying relationship with the front edge of the carton and which hold the front flap 29 in the inturned position whither it has been plowed by the edge 61 of the main plow 57. These spring fingers 97 slide over the upper fiberboard surface of the front flap 29 and press it downward against the just-sealed inner liner.

Figure 10:
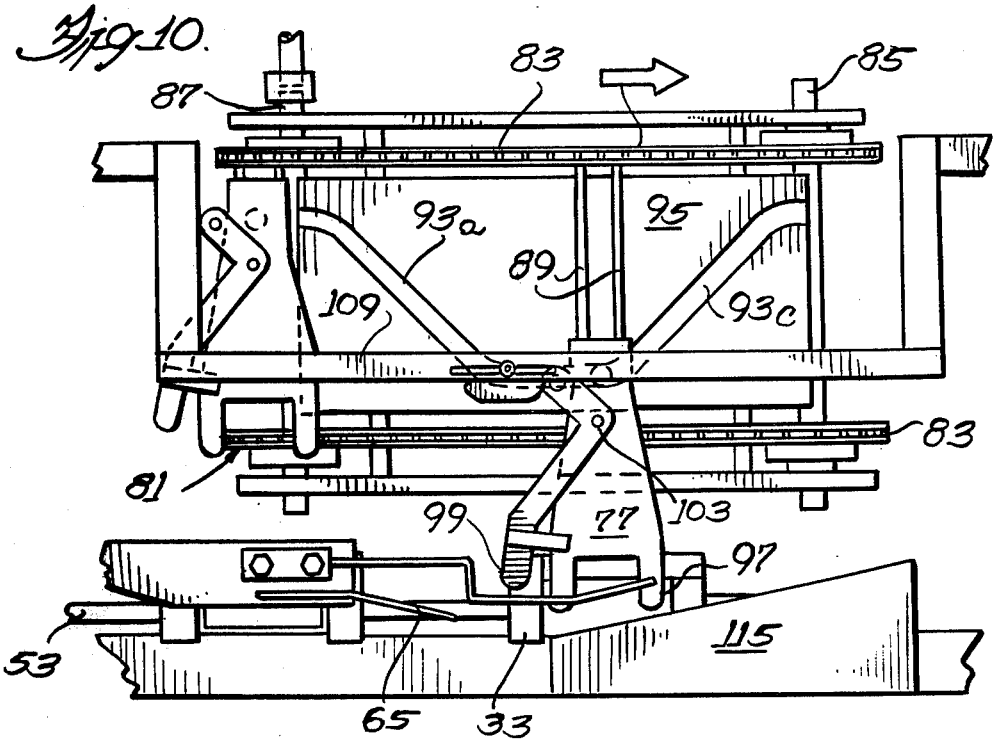
FIGS. 10 through 11 are enlarged, fragmentary views which illustrate the sequence of movement of the infolding unit during its operation in closing the upper end closure of a carton being carried along the main conveyor.
Figure 11:
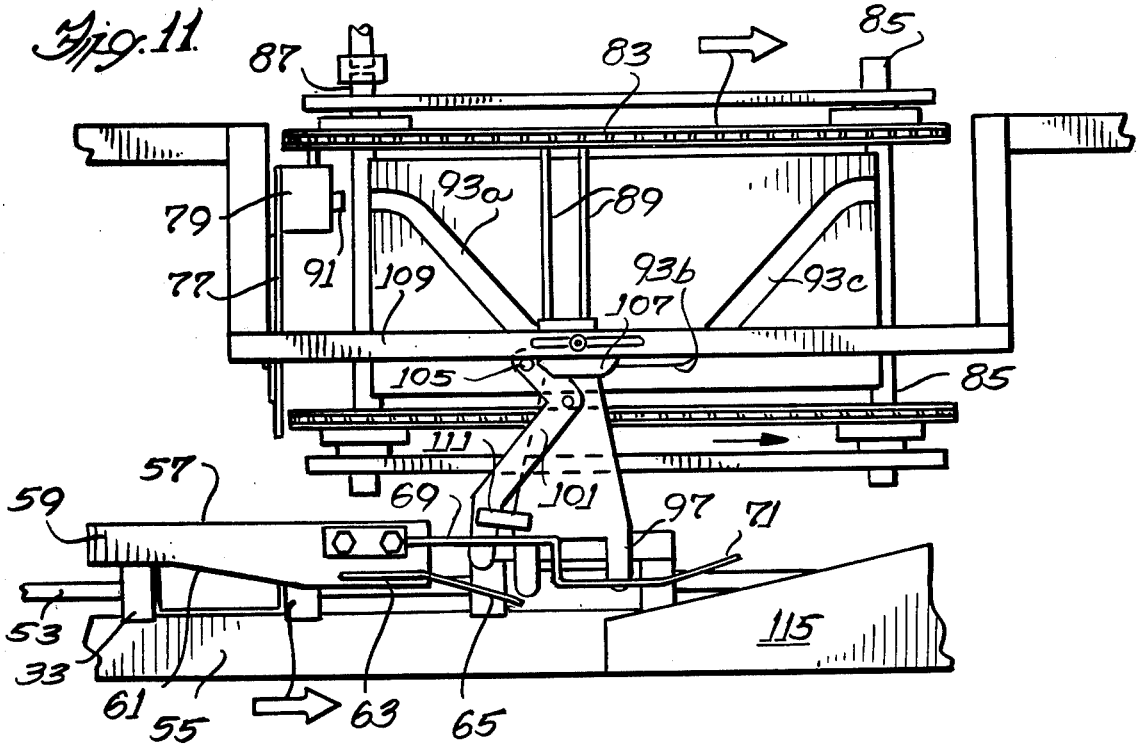
Figure 12:
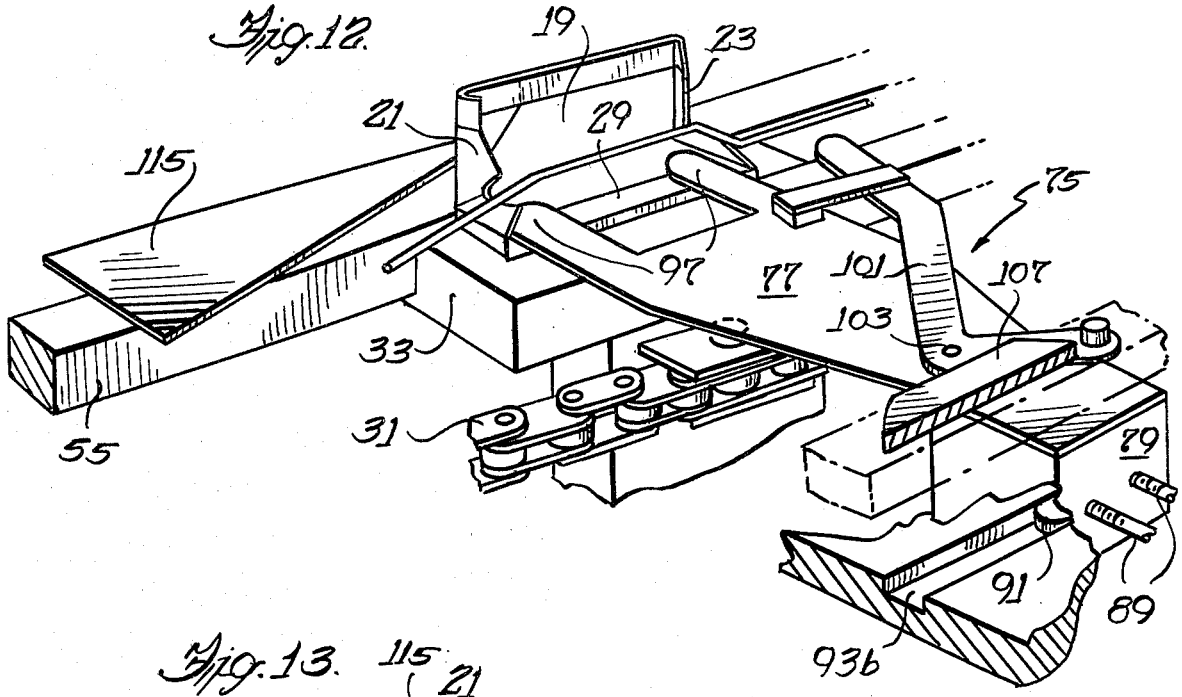

The cam track 93 is best seen in FIGS. 10 and 11. Outward movement of the carriage 79 and the folding head 77 occurs quickly as the cam follower 91 moves along the initial angled section **93*a* of the track. Thereafter, the cam track has a short straight section 93*b* where the folding head 77 moves along with the U-shaped pocket 33 with the spring fingers 97 disposed in overlying position. The head 77 carries a movable arm 99 that forms one end of a bell crank 101 which is mounted at a pivot point 103 on the upper surface of the infolding head. A cam follower or roller 105 extends upward from the other end of the bell crank 101, and it moves into engagement with the edge of an adjustable cam 107 that is supported on a slotted mounting bar 109 which overlies the infolding unit 75. A bolt allows precise positioning of the cam 107 along the slot to obtain the precise timed swinging movement of the arm 99**.

As the infolding head 77 moves into position with the spring fingers 97 overlying the carton, the main cam follower 91 enters the straight section **93*b* of the track. FIG. 11 shows the upstanding roller 105 just beginning to engage the edge of the overlying adjustable cam 107, and further movement of the head 77 causes the bell crank 101 to pivot counterclockwise, as viewed from above. Thus, the end of the arm 99 swings from a location just behind the trailing gusset to a more forward location (relative to the direction of conveyor movement) causing its edge to infold the narrower, trailing gusset flap 23. The head 77 preferably includes an overlying guide 111 under which the arm portion 99 of the bell crank swings. The guide 111 assures that the free end of the arm 99 does not slip past the edge of the gusset 23. The relative narrowness of the trailing gusset 23 allows it to be carried past the right angle portion 67 of the rod (which serves as the abutment that infolds the leading gusset 21**) without making contact with it.

Figure 13:
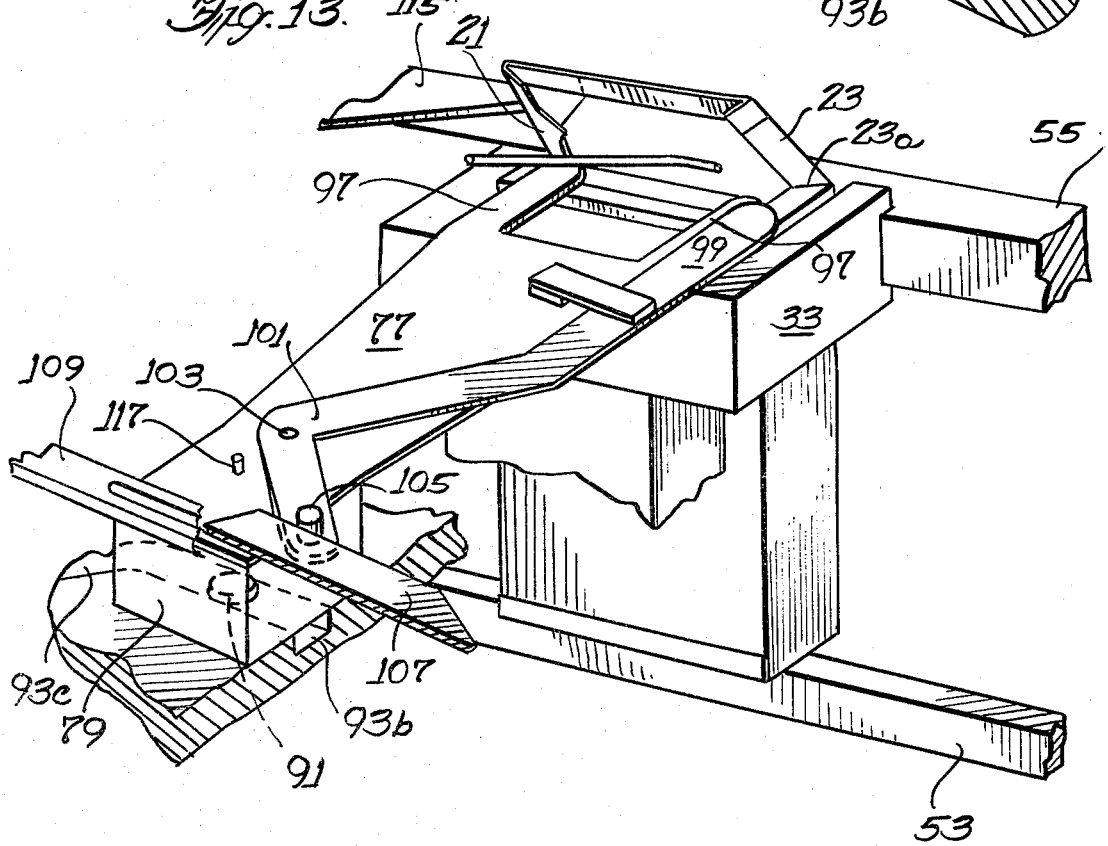

An overlying plow 115 is mounted on the main conveyor frame spaced slightly above the bar 55 and extends along the path of movement beginning at a location generally centrally of the infolding unit 75. The plow 115 extends over the path which the cartons take and folds the cover panel downward in cooperation with the infolding. The plow location is such that the leading gusset panel 21 has been infolded by the abutment 67 and is being held in the infolded position by the retainer portion of the rod 69 when contact is made between the arcuate edge of the plow 115 and the outer surface of the cover panel 19. By the time the infolding of the trailing gusset 23 has been accomplished, the plowing down of the cover panel 19 is well under way, as depicted in FIG. 13. Accordingly, the simultaneous downfolding of the cover panel 19 which is occurring at the completion of the infolding of the trailing gusset 23 assures that the infolded gusset will remain in its desired location underneath the overlying cover panel 19.

Just before the cam follower 91 reaches the end of the straight section **93*b* of the main cam track, the roller 105 reaches a curved section of the adjustable cam 107 which allows the bell crank 101 to swing back to its at-rest position. The bell crank 101 is suitably biased in this counterclockwise direction, as viewed from above, as by a spring (not shown) disposed about its pivot point 103 and a suitable stopper is provided, such as a peg 117 which extends upward from the surface of the head 77. Immediately after the arm 99 swings back to the at-rest position, the main cam follower 91 enters the angled return section 93*c* of the cam track causing the underlying carriage 79 to be drawn rearward, sliding along the pair of rods 89 and withdrawing the infolding head 77 from its association with the U-shaped pocket 33. The spring-fingers 97 slide out of contact with the front flap 29, and by this time, the cover panel 19 has been plowed downward sufficiently so that the leading edge of it is beginning to make contact with the upper surface of the flap 29. When the main cam follower leaves the end of the track 93**, the carriage is in its fully returned position, to which it is preferably biased, as by a spring (not shown), and is beginning its travel downward to the lower reach of the auxiliary chain conveyor.

At this point, the carton has been filled and sealed, and the top and bottom fiberboard portions of the end closures have been folded into their completed condition. Although final gluing could be effected at this time by extending the length of the machine, preferably the cartons are discharged into a suitable take-off device 37 which inserts them to a separate carton-gluer that applies a pattern of adhesive, for example hot melt, along the top and bottom edges of the front panel 11 and then plows the flange panels 25 into contact with the adhesive-coated front panel. A compression section of sufficient length holds these panels in contact with each other as the hot-melt adhesive quickly sets, and the fabrication of the package is complete when it leaves the compression section.

The invention provides an efficient infolding mechanism for manipulating the gusset panels of a continuously moving carton having an end closure of this general design. Although the invention has been described with regard to a certain preferred embodiment, it should be understood that changes and modifications as would be obvious to one having the ordinary skill in the art may be made without departing from the scope of the invention which is defined solely by the appended claims.

Certain features of the invention are emphasized in the claims which follow.

What is claimed is:

1. Apparatus for automatically folding the end closure of a carton of rectangular cross section having front, rear and two lateral sidewalls which end closure includes a major panel hinged to the rear sidewall of the carton and a pair of flanking gusset panels which are each respectively hinged to one edge of the major panel and to another sidewall of the carton, which apparatus comprises conveyor means for continuously moving said carton along a predetermined path with one of the gusset panels leading and the other gusset panel trailing, means for folding said gusset panels inward preliminary to the closing of said end closure including a folding head, means for moving said folding head in a horizontal plane along a path generally adjacent the front sidewall of the carton substantially parallel to said predetermined path, said folding head including an arm mounted for swinging motion in said horizontal plane, stationary abutment means mounted adjacent said predetermined path in a first location to contact the leading gusset panel at said conveyor means it therepast and fold it inward along a line at an angle to both hinged edges, means for moving said head horizontally toward said conveyor means so that said arm approaches said trailing gusset panel and, means for swinging said arm horizontally in the direction of movement of said conveyor so that it overlies the front sidewall of the carton and engages the trailing gusset panel at a second location downstream of said first location and folds it inward along a line at an angle to both hinged edges.

2. Apparatus in accordance with claim 1 wherein said conveyor means moves said carton continuously along a straight-line path section past said folding head and wherein said folding head moves at substantially the same rate of speed along said parallel path.

3. Apparatus in accordance with claim 2 wherein plow means is positioned adjacent said path in a position to plow the major panel toward the carton opening and wherein retainer means is provided which is located to hold the leading gusset panel in its infolded position until said plow means has begun to move the major panel.

4. Apparatus in accordance with claim 3 wherein said retainer means is a metal rod mounted along said path and bent so as to engage the surface of the leading gusset, which rod includes an adjacent section which lies about perpendicular to said direction of movement and constitutes said stationary abutment means for folding the leading gusset panel.

5. Apparatus in accordance with claim 4 wherein said head includes hold-down means which extends over the front sidewall of the carton and which overlies a flap hinged to such opposite sidewall.

6. Apparatus in accordance with claim 2 wherein a plurality of said folding heads are mounted on an endless conveyor, wherein a first cam track is mounted adjacent said endless conveyor and wherein a first cam follower carried by said folding head travels in said first cam track and causes said folding head to approach said conveyor, travel along with it in alignment with a carton carried thereon and then move away from it.

7. A method for automatically folding the end closure of a carton of rectangular cross section, which end closure includes a major panel hinged to a rear wall of the carton, a front flap hinged to a front wall and a pair of flanking gusset panels which are respectively hinged to one edge of the major panel and to opposite lateral sidewalls across the end of the carton, which method comprises continuously moving said carton along a predetermined path so that one of the gusset panels leads and the other gusset panel trails, folding said front flap inward and over the end of the carton, engaging said leading gusset panel at predetermined location along said path so as to cause the infolding of the leading gusset panel, subsequently depressing said inward-folded front flap to a substantially horizontal orientation and engaging said trailing gusset panel at a location downstream of said first predetermined location and infolding said trailing gusset panel of said continuously moving carton while said front flap is being depressed, and plowing the leading portion of said major panel downward toward the end of the carton as the infolding of said trailing gusset takes place.

8. A method in accordance with claim 7 wherein said infolding of said trailing gusset panel is performed by a head, which is traveling in a horizontal plane and along a parallel path to the path of said carton and at substantially the same speed, by moving a finger mounted on said head in a downstream direction in said horizontal plane.

9. A method in accordance with claim 8 wherein the folding head is moved horizontally into association with the carton prior to the infolding of the trailing gusset in a manner so as to overlie and depress said front flap and is withdrawn from association therewith following said infolding.

10. Apparatus for automatically folding the end closure of a carton of rectangular cross section which end closure includes a major panel hinged to one sidewall of the carton, a flap hinged to the opposite sidewall of the carton and a pair of flanking gusset panels which are each respectively hinged to one edge of the major panel and to another sidewall of the carton, which apparatus comprises main conveyor means for continuously moving said carton along a predetermined path having a least one straight-line section with one of the gusset panels leading and the other gusset panel trailing, means for folding said gusset panels inward preliminary to the closing of said end closure including a folding head, means for moving said folding head along a path substantially parallel to said straight-line path section and at substantially the same rate of speed as said carton, said folding head including an arm mounted for swinging motion and also including hold-down means which extends over said opposite sidewall of the carton and which overlies and depresses said flap, a plurality of folding heads mounted on an endless conveyor, a first cam track mounted adjacent said endless conveyor and a first cam follower carried by each of said folding heads and traveling in said first cam track, said track being designed to cause said folding heads to approach said main conveyor, travel along with it in alignment with a carton carried thereon and then move away from it, means mounted adjacent said predetermined path in a location to contact the leading gusset panel as said main conveyor moves it therepast and fold it inward along a line at an angle to both hinged edges, means for moving said head toward said main conveyor means so that said arm approaches said trailing gusset panel and means for swinging said arm in the direction of movement of said main conveyor so that it engages the trailing gusset panel and folds it inward along a line at an angle to both hinged edges.

11. Apparatus for automatically folding the end closure of a carton of rectangular cross section which end closure includes a major panel hinged to one sidewall of the carton and a pair of flanking gusset panels which are each respectively hinged to one edge of the major panel and to another sidewall of the carton, which apparatus comprises main conveyor means for continuously moving said carton along a predetermined path having at least one straight-line section with one of the gusset panels leading and the other gusset panel trailing, means for folding said gusset panels inward preliminary to the closing of said end closure including a plurality of folding heads mounted on an endless conveyor, said endless conveyor and said folding heads being movable along a path substantially parallel to said straight-line path section and at substantially the same rate of speed as said carton, a first cam track is mounted adjacent said endless conveyor and a first cam follower carried by each of said folding heads and traveling in said first cam track, said track being designed to cause said folding heads to approach said main conveyor, travel along with it in alignment with a carton carried thereon and then move away from it, said folding head including an arm mounted for swinging motion, means mounted adjacent said predetermined path in a location to contact the leading gusset panel as said main conveyor moves it therepast and fold it inward along a line at an angle to both hinged edges, means for moving said head toward said main conveyor means so that said arm approaches said trailing gusset panel, a second cam track mounted adjacent the location along said main conveyor means where said folding head travels along with said main conveyor, a second cam follower carried by said arm which contacts said second cam track and swings said arm in folding contact with the trailing gusset panel in the direction of movement of said main conveyor so that it engages the trailing gusset panel and folds it inward along a line at an angle to both hinged edges while said folding head and said carton are moving along parallel paths.

* * * * *

UNITED STATES PATENT AND TRADEMARK OFFICE

CERTIFICATE OF CORRECTION

PATENT NO. : 4,251,978

DATED : February 24, 1981

INVENTOR(S) : Charles C. Beck

It is certified that error appears in the above—identified patent and that said Letters Patent is hereby corrected as shown below:

Column 2, line 16, "11" should be --13--.

Column 2, line 24, "gusset" should be --gusseted--.

Column 2, line 45, "side-scanning" should be --side-seaming--.

Column 4, line 51, "sheets" should be --heads--.

Column 7, line 5, "at" should be --as-- and "means" should be --moves--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*